US005203276A

United States Patent [19]

Methven

[11] Patent Number: 5,203,276

[45] Date of Patent: Apr. 20, 1993

[54] SUITCASE BOAT

[76] Inventor: Robert W. Methven, 984 S. Victor Way, Aurora, Colo. 80012

[21] Appl. No.: 853,908

[22] Filed: Mar. 19, 1992

[51] Int. Cl.[5] ..... B63H 9/04

[52] U.S. Cl. ..... 114/354; 114/39.1; 114/162; 114/61

[58] Field of Search ..... 114/343, 352, 353, 354, 114/39.1, 162, 61, 123

[56] References Cited

U.S. PATENT DOCUMENTS

| | | | |
|---|---|---|---|
| 1,932,245 | 10/1933 | Horak | 114/354 |
| 2,916,748 | 12/1959 | Stahmer | 114/352 |
| 2,919,451 | 1/1960 | Long | 114/352 |
| 3,126,558 | 3/1964 | Nolan et al. | 114/352 |
| 3,179,960 | 4/1965 | Nimmo | 114/354 |
| 4,319,538 | 3/1982 | Macfarlane | 114/162 |
| 4,553,496 | 11/1985 | Foresman | 114/162 |
| 4,998,498 | 3/1991 | Gallichan | 114/354 |

*Primary Examiner*—Jesus D. Sotelo
*Assistant Examiner*—Stephen P. Avila
*Attorney, Agent, or Firm*—Mason, Kolehmainen, Rathburn & Wyss

[57] ABSTRACT

A suitcase boat in accordance with the invention comprises a relatively flat, stiff platform for supporting a person and/or objects while the boat is on the water. The platform includes a plurality of rectangular sections hingedly interconnected along parallel axes normal to the longitudinal axis of the boat. The sections are relatively foldable at right angles along the transverse axes to form a hollow rectangular enclosure similar to the form of a rectangular suitcase. A plurality of floatation elements are provided adapted to support the platform on the water when the sections are unfolded or extended in substantially coplanar alignment. The floatation elements are dimensioned for containment within the hollow enclosure when the sections are folded into suitcase form. Elongated straps of flexible material are provided for securing the floatation elements to the platform in position for floatation support of the boat with the sections unfolded or extended and for retaining the platform sections in the folded up form of a suitcase containing the floatation elements when folded up ready for transport. The boat is useful as a rowboat, dinghy, power boat, sail boat or motor boat and can be easily transported from place to place when folded up in suitcase form.

13 Claims, 2 Drawing Sheets

SUITCASE BOAT

BACKGROUND OF THE INVENTION

1. Field of the Invention the present invention relates to a new and improved suitcase boat which includes a platform formed of hingedly interconnected sections which may be unfolded to provide a flat, elongated support platform of the boat while floating on the water with floatation elements secured to the underside of the platform. When the sections of the platform are folded up to form a hollow, suitcase-like enclosure, the floatation elements may be contained within the enclosure and flexible straps are provided for securing the floatation elements in place both when used as a boat on the water and when in a suitcase mode suitable for traveling.

2. Background of the Prior Art

Fold up boats, inflatable boats and a wide variety of wood, foam and fiberglass dinghies are available for use as yacht tenders, rowboats, power boats and sailing boats.

OBJECTS OF THE INVENTION

It is an object of the invention to provide a new and improved suitcase boat which is easily transportable in the form of a suitcase-like package.

Another object of the present invention is to provide a new and improved suitcase boat of the type described which easily changes from a folded up suitcase form to an unfolded condition for use as a boat on the water.

Yet another object of the present invention is to provide a new and improved suitcase boat of the character described which employs a plurality of flat sections, hingedly interconnected together to form a suitcase enclosure for carrying a plurality of floatation elements.

Still another object of the present invention is to provide a new and improved suitcase boat of the character described which readily unfolds from suitcase form to provide a platform supported on a plurality of floatation elements detachably secured thereto.

Another object of the present invention is to provide a new and improved suitcase boat of the character described which can function as a dinghy or a yacht tender, a rowboat, a power boat, a sail boat or a fishing boat as the case may be.

Still another object of the present invention is to provide a new and improved suitcase boat of the character described which employs a plurality of substantially identical floatation elements adapted to be detachably interconnected to a substantially planar platform for supporting a person or persons and gear.

Yet another object of the present invention is to provide a new and improved suitcase boat which occupies a minimum amount of space or volume when folded up and thus is easily transportable in suitcase form on airplanes and other public conveyances.

Still another object of the present invention is to provide a new and improved suitcase boat which is relatively low in cost, relatively light in weight, relatively small in volume when in suitcase form and yet capable of providing normal functions of a dinghy, small sail boat or power boat and/or rowboat or fishing boat.

BRIEF SUMMARY OF THE PRESENT INVENTION

The foregoing and other objects and advantages of the present invention are accomplished in a new and improved suitcase boat comprising a relatively flat, stiff, multi-section platform for supporting a person and/or gear while the boat is on the water. The platform includes a plurality of flat rectangular sections hingedly interconnected along parallel axes that are normal to a longitudinal axis of the boat. Each section is foldable at right angles along a transverse axis to form a complete hollow, rectangular enclosure similar to the form of a suitcase. A plurality of floatation elements are adapted to be secured to the unfolded sections which are arranged in substantially coplanar alignment for use on the water. The floatation elements are substantially identical to one another and are dimensioned to be contained within the hollow enclosure formed when the platform sections are folded into a rectangular suitcase form. Flexible straps are provided for securing the floatation elements to the underside of the extended folded out platform ready for boating and for retaining the folded up platform sections within the suitcase-like enclosure form ready for transport.

BRIEF DESCRIPTION OF THE DRAWINGS

For a better understanding of the present invention, reference should be had to the following detailed description taken in conjunction with the drawings, in which.

DETAILED DESCRIPTION OF A PREFERRED EMBODIMENT OF THE INVENTION

Figure 1:
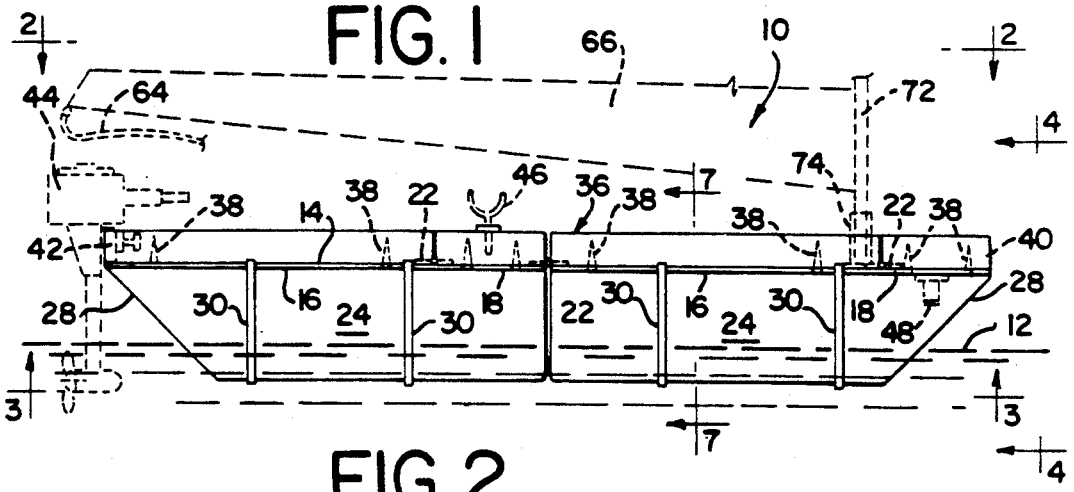
FIG. 1 is a side elevational view of a new and improved suitcase boat constructed in accordance with the features of the present invention and shown with platform section in an unfolded or extended condition while the boat is floating on a water surface.
Figure 2:
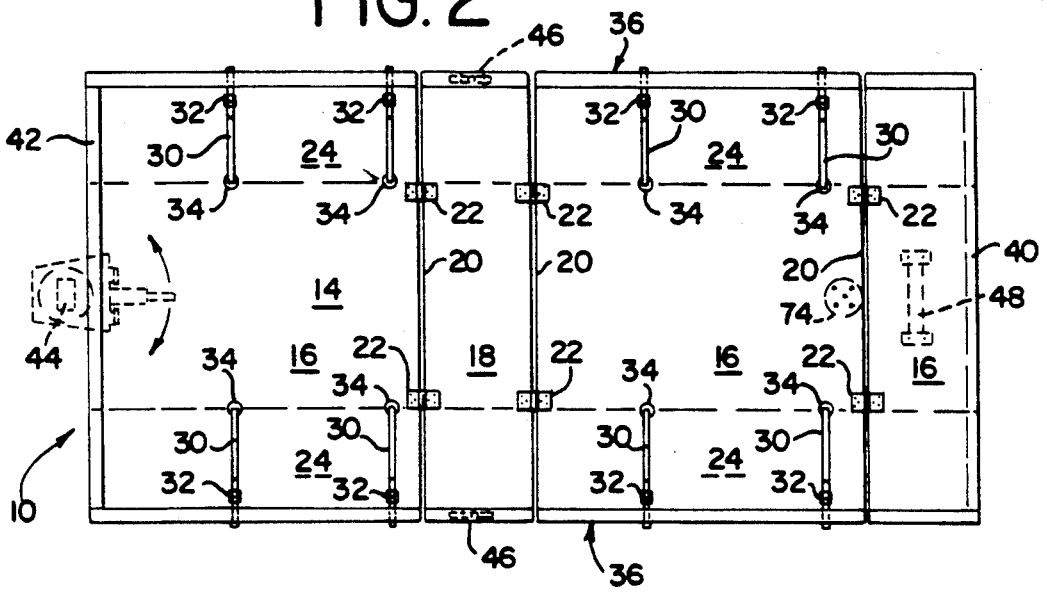
FIG. 2 is a top plan view of the boat looking downwardly along lines 2—2 of FIG. 1.
Figure 3:
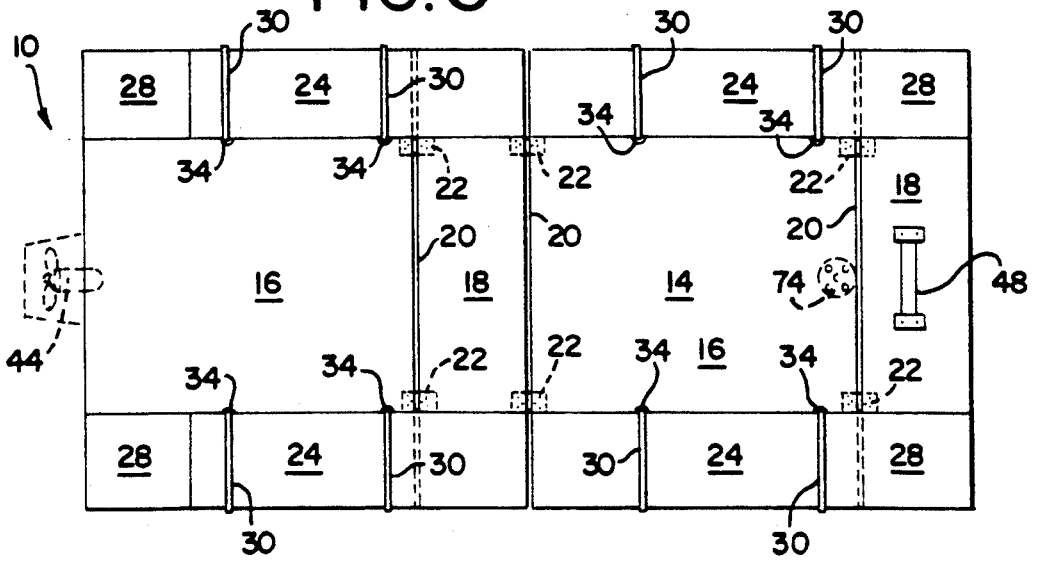
FIG. 3 is a bottom plan view of the boat looking upwardly in the direction of arrows 3—3 of FIG. 1.

Referring now more particularly to the drawings, therein is illustrated a new and improved suitcase boat constructed in accordance with the present invention and referred to generally by the reference numeral 10. As indicated best in FIGS. 1-4 and 8, the new and improved suitcase boat 10 is useful as a floating platform, a rowboat, a motor boat or a sail boat when the boat is in extended condition as illustrated in FIGS. 1-4, ready for use on the surface of a body of water 12. The boat 10 includes a rectangular platform 14 formed of strong, relatively stiff or rigid thin sheet material such as a four foot by eight foot rectangular sheet of marine plywood, one-half or five eighths of an inch in thickness. Other types of sheet materials can also be used.

In accordance with the present invention, the platform 14 is divided into four rectangular sections including a pair of relatively large sections 16 disposed alternately with a pair of relatively narrow sections 18. Adjacent platform sections 16 and 18 are hingedly interconnected to one another for pivotal movement about transversely extending axes or fold lines 20 at right angles to a longitudinal axial centerline of the boat. For example, if a four by eight sheet of plywood is used for the platform 14, the large rectangular sections 16 are cut to a size three feet by four feet and the small or narrow sections 18 are one foot by four foot in size. Pairs of hinges 22 are provided along each transverse fold line 20 so that the platform 14 may be folded up from the extended position of FIG. 1 to a suitcase form configuration as shown in FIGS. 5 and 6 into a relatively compact in size package, for example, three by four by one foot in dimensions.

Figure 4:
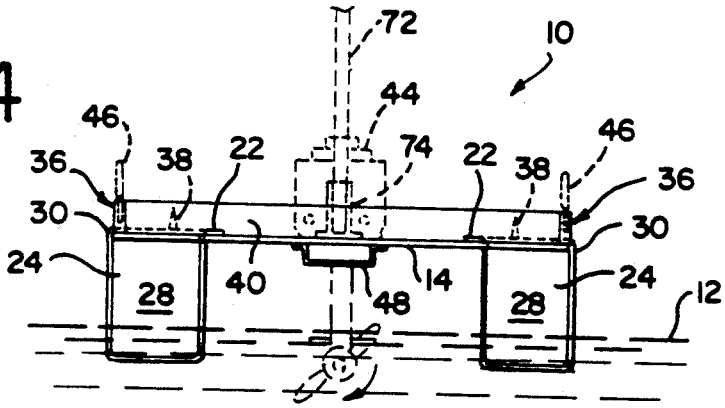
FIG. 4 is a front end elevational view of the boat looking substantially in the direction of arrows 4—4 of FIG. 1.

In accordance with the present invention, the suitcase boat 10 includes a plurality of elongated floatation elements 24 preferably formed of lightweight, strong, closed cell polyurethane or polystyrene foam. The floatation elements or floats 24 are substantially identical and have a generally rectangular cross-section as shown in FIGS. 4, 6 and 7. Preferably, the foam body of the floats 24 are encased within a polyethylene or polypropylene jacket 26 and each float is provided with a beveled portion 28 at one end (FIG. 1) so that when a pair of floats are aligned end to end along opposite sides of the extended platform 14, the beveled end portions of each pair face forwardly and rearwardly in opposite directions as shown in FIG. 1.

Figure 5:
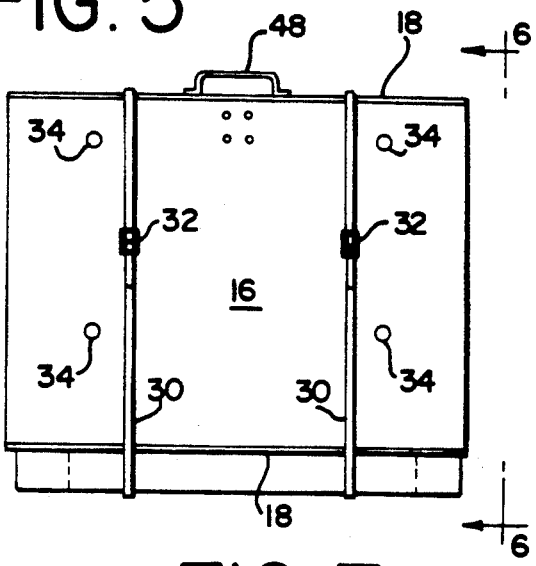
FIG. 5 is a side elevational view of the suitcase boat in a folded up or suitcase configuration.
Figure 6:
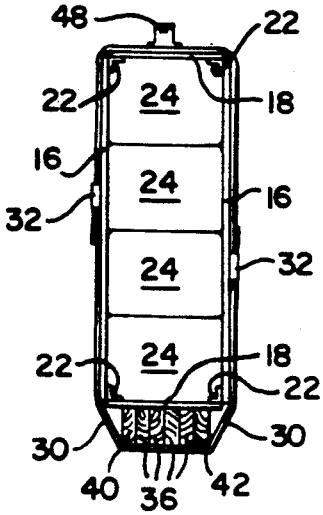
FIG. 6 is an end elevational view of the folded up suitcase boat looking in the direction of arrows 6—6 of FIG. 5.
Figure 7:
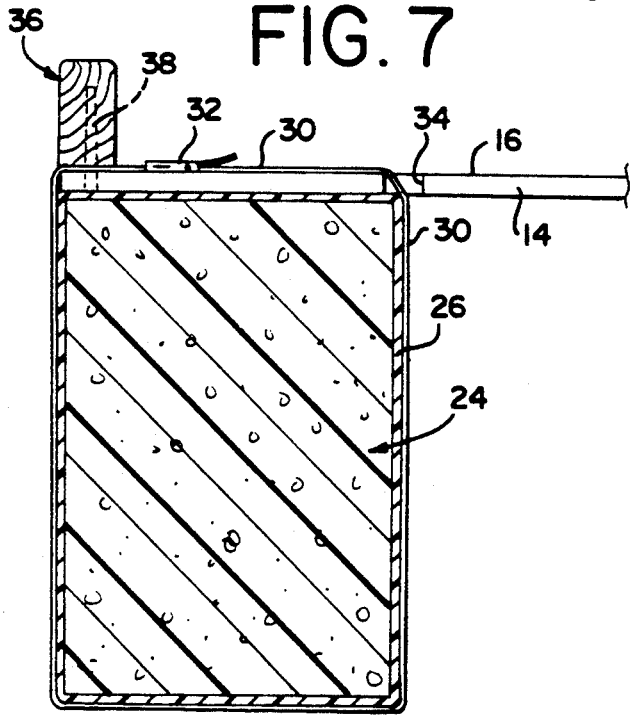
FIG. 7 is an enlarged fragmentary transverse cross-sectional view looking in the direction of arrows 7—7 of FIG. 1.
Figure 8:
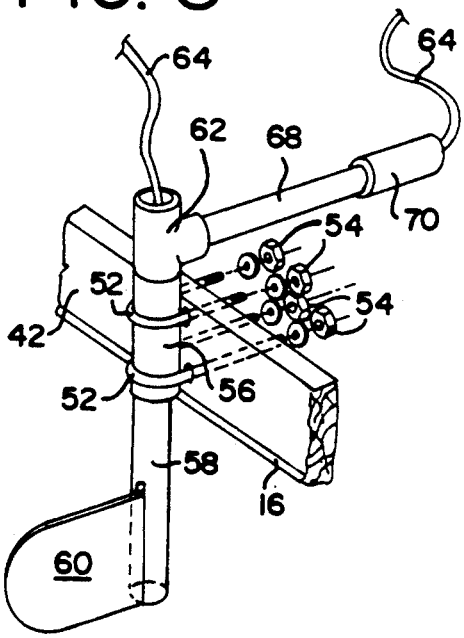
FIG. 8 is a fragmentary perspective view of a rear end portion of the boat illustrating a detachable rudder, steering and tiller mechanism in accordance with the features of the present invention.

When the suitcase boat 10 is folded up for transport as shown in FIGS. 5 and 6, the floats 24 are contained within the interior of the hollow enclosure and accordingly, the floats are properly dimensioned to fit neatly within the interior space. For example, in the embodiment wherein the suitcase is dimensioned to be three feet by four feet by one foot, the floats 24 are constructed to have a transverse cross-section of nine inches by twelve inches and are four feet long so as to be completely contained within the suitcase structure and protected from damage by the platform sections 16 and 18 surrounding the same.

In accordance with the present invention, each float 24 is secured to the platform 14 when extended or unfolded as shown in FIGS. 1–4 by a pair of flexible straps or webs 30 having buckles 32 for tightening the straps as needed to firmly secure the floats 24 on the underside of the extended platform 14. The straps 30 are preferably formed of "Nylon" resin which is strong and water-resistant. When the boat 10 is in folded up configuration as shown in FIGS. 5 and 6, in readiness for transport, pairs of flexible straps 30 are connected end to end to completely surround the suitcase-like form. The straps 30 serve a dual purpose in securing the floats 24 to the underside of the platform 14 when the platform is unfolded and extended for use as a boat, as well as for securing the boat in a folded up suitcase form ready for transport as shown in FIGS. 5 and 6. As best shown in FIG. 7, when the platform 14 is unfolded and extended and the floats 24 are secured to the underside thereof, each strap 30 is passed around the cross-section of a float, over an outside edge of the platform 14 through a port or opening 34 in a platform section 16 or 18 spaced inwardly of the outer edge.

In accordance with the present invention, when the platform 14 is unfolded and extended for use as a boat, elongated side rails 36 of wood or plastic are mounted on opposite side edges of the platform 14 and are secured to the upper surface of the platform by means of a plurality of screws 38 or other suitable fasteners. In addition to the elongated side rails 36, the platform 14 is also provided with a transverse front end rail 40 and a transverse rear end rail 42 which serves as a transom for supporting an outboard motor 44 clamped in place thereon in a conventional manner when the suitcase boat is used as a motor boat. The elongated side rails 36 are generally formed of wood such as a two by four and each side rail 36 comprises a plurality of separate segments aligned end to end to provide a a length corresponding to the longitudinal dimension of the platform section 16 or 18 on which the side rail is attached. When the suitcase boat 10 is used as a rowboat, oar locks 46 may be provided and mounted in place as shown approximately midway between opposite ends on the side rails 36.

In accordance with the present invention, the suitcase boat 10 is provided with a forward handle 48 mounted on the underside of the forward platform section 18. The handle 48 functions as a bow eye as well as a handle for carrying the suitcase boat in suitcase form as shown in FIGS. 5 and 6.

The suitcase boat 10 is adapted for use as a sail boat and includes a detachable rudder assembly 50 (FIG. 8) which is securable to the rear end rail 42 by a plurality of U-bolts 52 and nuts and washers 54 on the threaded legs of the U-bolts. The U-bolts 52 extend around a hollow bearing member 56, preferably formed of PVC pipe. A rudder post 58, also formed of a piece of PVC is supported in the bearing 56. A rudder 60 is attached to the lower end of the hollow rudder post 58 and a tee fitting 62 is mounted at the upper end. The tee which is open on top to receive a flexible main sheet or line 64 for controlling the position of a sail 66 (FIG. 1). The rudder assembly 50 also includes a hollow tiller arm 68 of PVC pipe open at the outer end to permit the main sheet 64 to pass through an open-ended tiller handle 70 mounted on the arm. The sail 66 is supported on an upstanding mast 72 having a lower end portion seated in an upstanding hollow stanchion 74 having a flange at the lower end bolted to the forward platform section 16.

From the foregoing, it will be appreciated that the suitcase boat 10 is easily transportable when the platform 14 is folded up to form a compact suitcase-like package as shown in FIGS. 5 and 6. When the platform is unfolded and extended so that the large platform sections 16 and the narrow platform sections 18 are aligned on a common plane, the floats 24 are easily secured to the underside of the platform using the flexible straps 30 as described. The boat 10 is relatively low in cost and is constructed of easily obtainable materials. The boat 10 is useful as a floating platform, a motor boat, a sail boat and a rowboat as desired. The boat is relatively light in weight, easy to assemble and disassemble, and is compact enough in size while in suitcase form to be transportable on common public conveyances such as airplanes, buses, trains, cars and the like.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. A suitcase boat, comprising:

platform means for supporting a person(s) and/or object(s) while said boat is on the water, said platform means comprising a plurality of sections hingedly interconnected and relatively foldable to form a hollow rectangular enclosure similar to the form of a suitcase;

said sections being hingedly interconnected along parallel axes transversely of a longitudinal axis of said boat and providing pairs of opposite walls of said suitcase when said sections are folded at right angles to one another;

a first pair of said sections comprising opposite side walls of said suitcase and a second pair of said sections comprising top and bottom walls of said suitcase;

a plurality of floatation elements adapted to support said platform means on the water while said sections are unfolded and dimensioned to be contained within said hollow enclosure when said sections are folded into suitcase form; and attachment means for securing said floatation elements to said platform means in position for providing floatation support for said boat and for retaining said sections of said platform means in said folded up form of a suitcase for containing said floatation elements in said hollow enclosure.

2. The suitcase boat of claim 1, wherein:

said platform means is initially made from a planar sheet of relatively stiff material.

3. The suitcase boat of claim 1, wherein:

said floatation elements extend transversely across at least one of said axes.

4. A suitcase boat, comprising:

platform means for supporting a person(s) and/or object(s) while said boat is on the water, said platform means comprising a plurality of sections hingedly interconnected and relatively foldable to form a hollow rectangular enclosure similar to the form of a suitcase;

said platform means initially comprising a planar sheet of relatively stiff material divided into a plurality of pairs of equal size sections of rectangular shape hingedly connected, a first pair of said equal size sections providing opposite side walls of said suitcase and a second pair of said equal size sections providing opposite top and bottom walls of said suitcase generally normal to said first pair while folded to form said suitcase and wherein said sections are generally coplanar while said boat is floatable on the water;

a plurality of floatation elements adapted to support said platform means on the water while said sections are unfolded and dimensioned to be contained within aid hollow enclosure when said sections are folded into suitcase form; and attachment means or securing said floatation elements to said platform means in position for providing floatation support for said boat and for retaining said sections of said platform means in said folded up form of a suitcase for containing said floatation elements in said hollow enclosure.

5. The suitcase boat of claim 4, wherein:

said platform means is made of plywood.

6. A suitcase boat, comprising:

a relatively flat, stiff platform for supporting a person(s) and/or object(s) while said boat is on the water, said platform including a plurality of rectangular sections hingedly interconnected along parallel axes normal to a longitudinal axis of said boat, said sections being relatively foldable at right angles along said transverse axes to form a hollow rectangular enclosure similar to the form of a suitcase;

end rail means parallel of aid transverse axes along an outer nd of said platform when said sections are unfolded, ruder means for steering said boat detachably mountable on said end rail means and pivotal about an upstanding axis, said rudder means including a hollow upstanding post member open at an upper end and having a rudder mounted adjacent a lower end portion and a hollow steering tiller joined to said post normal thereto at one end and having an open forward end;

said hollow post and said hollow tiller providing a continuous passage for guiding a flexible line extending downwardly into said open upper end of said post and out through said forward open end of said tiller for controlling the position of a sail relative to said platform;

a plurality of floatation elements adapted to support said platform on the water while said sections are unfolded in substantially coplanar alignment, said elements being dimensioned for containment within said hollow enclosure when said sections are folded into suitcase form; and flexible strap means for securing said floatation elements to the underside of said platform in position for providing floatation support for said boat and also adapted for retaining said sections of said platform in said folded up form of a suitcase for containing said floatation elements in said hollow enclosure.

7. The suitcase boat of claim 6, wherein:

said floatation elements are substantially identical in size and shape.

8. The suitcase boat of claim 7, wherein:

said floatation elements are made of lightweight closed cell foam material.

9. The suitcase boat of claim 8, wherein:

said foam material is enclosed within an outer jacket of thin sheet plastic material.

10. The suitcase boat of claim 6, wherein:

said floatation elements are aligned end to end in pairs parallel of said longitudinal axis.

11. The suitcase boat of claim 10, wherein:

said pairs of aligned floatation elements are spaced apart on opposite sides of said longitudinal 12. The suitcase boat of claim 6, wherein:

at least one pair of said floatation elements extend longitudinally across at least one of said transverse axes when said sections of said platform are unfolded.

13. The suitcase boat of claim 6, including:

side rail means mountable along longitudinal opposite edges of said platform when said sections are unfolded.

* * * * *